US009969200B2

(12) United States Patent
Yokoyama

(10) Patent No.: US 9,969,200 B2
(45) Date of Patent: May 15, 2018

(54) DECOLORING APPARATUS AND METHOD FOR OPERATING THE SAME

(71) Applicants: KABUSHIKI KAISHA TOSHIBA, Tokyo (JP); TOSHIBA TEC KABUSHIKI KAISHA, Tokyo (JP)

(72) Inventor: Kenji Yokoyama, Izu Shizuaoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 303 days.

(21) Appl. No.: 14/614,590

(22) Filed: Feb. 5, 2015

(65) Prior Publication Data

US 2016/0229212 A1 Aug. 11, 2016

(51) Int. Cl.

| | |
|---|---|
| ***G03G 15/20*** | (2006.01) |
| ***B41M 7/00*** | (2006.01) |
| ***G03G 15/01*** | (2006.01) |
| ***G03G 21/00*** | (2006.01) |

(52) U.S. Cl.

CPC ..... *B41M 7/0009* (2013.01); *G03G 15/01* (2013.01); *G03G 21/00* (2013.01)

(58) Field of Classification Search

USPC ..... 399/38, 45, 67–70, 391

See application file for complete search history.

(56) References Cited

U.S. PATENT DOCUMENTS

| | | | | |
|---|---|---|---|---|
| 6,519,424 | B2 * | 2/2003 | Matsuura | G03G 15/221 399/45 |
| 7,050,751 | B2 * | 5/2006 | Watanabe | G03G 15/6558 399/391 |
| 7,203,436 | B2 * | 4/2007 | Imamiya | G03G 9/09 399/53 |
| 8,396,387 | B2 * | 3/2013 | Inaba | G03G 15/5004 399/43 |
| 8,406,639 | B2 * | 3/2013 | Yamanaka | B65H 1/266 399/23 |
| 8,918,002 | B2 * | 12/2014 | Ogasawara | G03G 15/205 399/223 |
| 8,934,141 | B2 * | 1/2015 | Hagiwara | G03G 15/6588 358/2.1 |
| 2010/0233597 | A1 | 9/2010 | Roof | |

* cited by examiner

*Primary Examiner* — Hoan Tran

(74) *Attorney, Agent, or Firm* — Patterson & Sheridan, LLP

(57) ABSTRACT

A decoloring apparatus includes an erasing unit configured to generate heat so as to erase an image formed on a sheet with an erasable material, a sheet storing unit to store one or more sheets, each having the image formed thereon with the erasable material, a sheet conveying unit configured to convey the sheets from the sheet storing unit to the erasing unit, a quantity sensor configured to detect a quantity of the sheets stored in the sheet storing unit, and a control unit configured to determine whether or not the detected quantity is greater than a predetermined value, and control the sheet conveying unit to convey the sheets and the erasing unit to generate heat, when the detected quantity is determined to be greater than the predetermined value.

20 Claims, 11 Drawing Sheets

DECOLORING APPARATUS AND METHOD FOR OPERATING THE SAME

FIELD

Embodiments described herein relate generally to a decoloring apparatus and a method for operating the decoloring apparatus.

BACKGROUND

An image forming apparatus forms an image with decoloring toner. A decoloring apparatus erases a toner image on a sheet printed by such an image forming apparatus by heating the toner image. Such a decoloring apparatus consumes energy to heat the toner image. Efficiently operating the erasing apparatus to reduce the amount of energy consumed is desired.

DESCRIPTION OF THE DRAWINGS

The accompanying drawings, which are incorporated in and constitute a part of this disclosure, illustrate an embodiment of the invention and together with the description, serve to explain the principles of the invention.

DETAILED DESCRIPTION

In general, according to one embodiment, a decoloring apparatus includes an erasing unit configured to generate heat so as to erase an image formed on a sheet with an erasable material, a sheet storing unit to store one or more sheets, each having the image formed thereon with the erasable material, a sheet conveying unit configured to convey the sheets from the sheet storing unit to the erasing unit, a quantity sensor configured to detect a quantity of the sheets stored in the sheet storing unit, and a control unit configured to determine whether or not the detected quantity is greater than a predetermined value, and control the sheet conveying unit to convey the sheets and the erasing unit to generate heat, when the detected quantity is determined to be greater than the predetermined value.

Reference will now be made in detail to the present embodiment of the invention, and example of which is illustrated in the accompanying drawing.

Hereinafter, the present embodiment will be described with reference to the drawings. The same reference numbers are used in the following description, with respect to the same configuration and function.

First Embodiment

Figure 1:
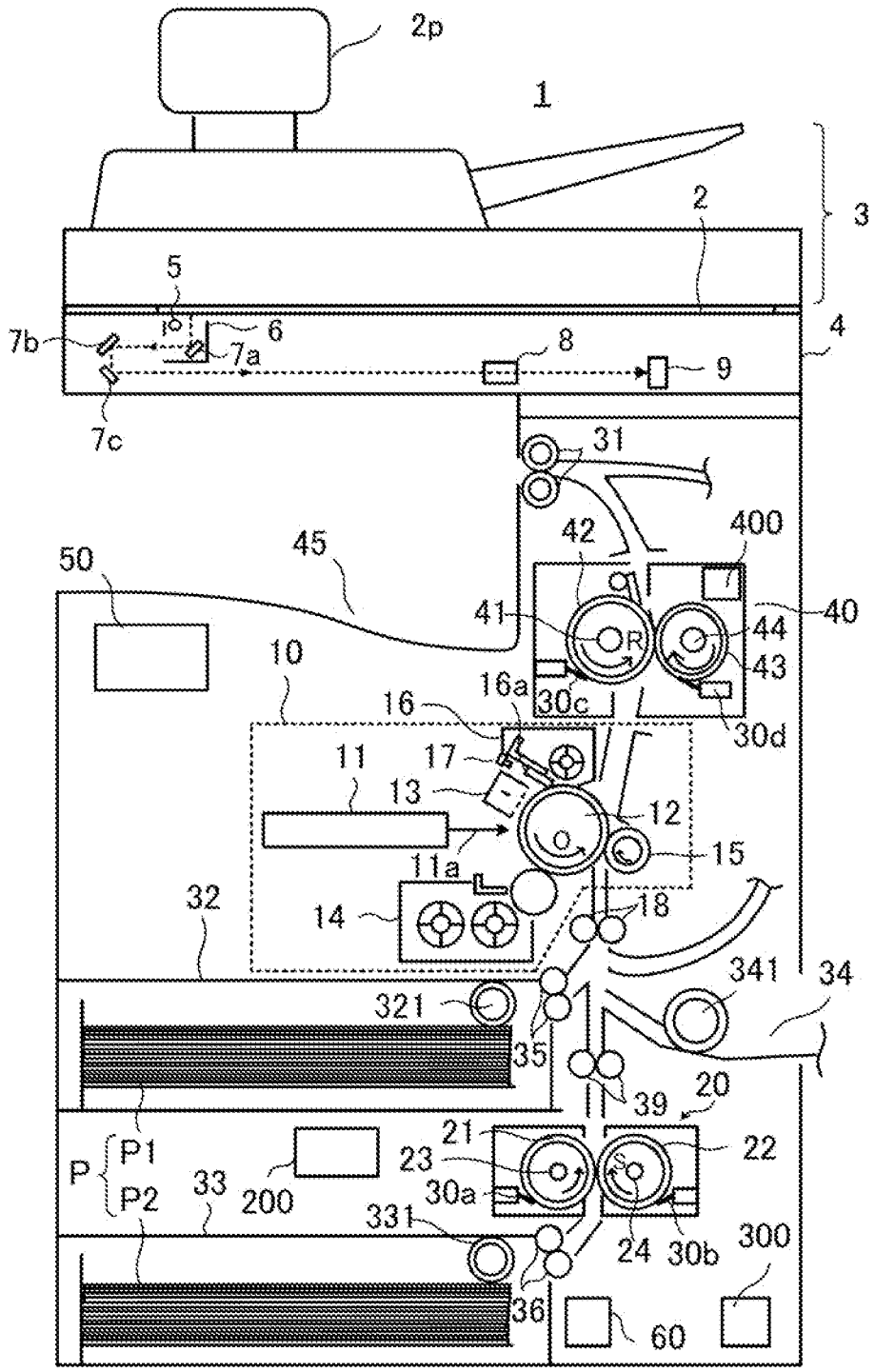
FIG. 1 illustrates a decoloring apparatus, which includes an image forming function, according to a first embodiment.

FIG. 1 illustrates a decoloring apparatus (image forming apparatus) according to a first embodiment. As illustrated in FIG. 1, a document platen 2 for supporting a document, which is formed of a transparent material, such as a sheet of glass, and an operation panel 2*p* above the document platen 2 are provided on an upper part of an image forming apparatus 1. The operation panel 2*p* displays an operational state of the image forming apparatus 1, is, for example, a touch panel, such that an operator may touch and select one option that is displayed and may input various data thereto, and is disposed such that a direction of a display screen may be changed. A sheet according to the embodiment is a sheet on which a toner image is formed with decolorable toner that is decolorable through heating.

In addition, an auto document feeder (ADF) 3 that continuously transports original document sheets is disposed in an openable and closable manner to cover the document platen 2. A scanner 4 that optically scans an image on a document placed on the document platen 2 is provided on the lower surface side of the document platen 2.

The scanner 4 includes, for example, a carriage 6 that includes an optical source 5 that irradiates the document with a light beam, reflective mirrors 7*a*, 7*b*, and 7*c* that reflect the light beam emitted from the optical source 5 and reflected by the document, a magnifying lens block 8 that magnifies the reflected light beam, and a charge coupled device (CCD) 9. The carriage 6 is provided such that it can reciprocate along the lower surface of the document platen 2.

The carriage 6 irradiates the document placed on the document platen 2 with a light beam while the carriage 6 reciprocates and the optical source 5 is turned on. An image formed with a light beam reflected by the document and guided by the reflective mirrors 7*a*, 7*b*, and 7*c* and the magnifying lens block 8 is incident on the CCD 9.

The CCD 9 outputs a digital-encoded image signal corresponding to the optical image obtained from the document to an image process circuit. The image signal on which an image data processing is appropriately performed by an image data processing circuit is output to a laser unit 11 of an image forming unit 10. The image forming unit 10 executes an image forming process in which a toner image corresponding to the image signal output from the CCD 9 is formed on a recording medium P, such as a sheet.

The image forming unit 10 includes an image carrier 12 that has an organic photoconductor (OPC) on the front surface thereof, a corona charger 13 for uniformly charging a surface of the image carrier 12, the laser unit 11 for forming an electrostatic latent image on the image carrier 12, a developing device 14 that has a developing roller for developing the electrostatic latent image on the image carrier 12 by supplying a developer, a transfer roller 15, a cleaner 16 for removing and collecting residual toner or the like, and a discharge lamp 17 for removing charge on the image carrier 12 after the transfer.

The image carrier 12 includes the organic photoconductor (OPC) on its surface, and rotates in an arrow O direction at a circumferential velocity of 136 mm/sec. The corona charger 13, the laser unit 11, the developing device 14, the transfer roller 15, the cleaner 16, and the discharge lamp 17 are disposed in this order around the image carrier 12 in the rotational direction of the image carrier 12.

The corona charger 13 is a scorotron-type corona charger and uniformly charges the surface of the image carrier 12 to have a negative polarity. Scanning exposure with a laser beam (semiconductor laser) 11*a* from the laser unit 11 is performed on the uniformly charged image carrier 12 by 600 dpi resolution according to the image signal obtained by the scanner 4, and, as a result, an electrostatic latent image is formed on the image carrier 12.

Two-component developer charged to have a negative polarity is stored in the developing device 14. Two-component toner is formed of, for example, a mixture of decolorable toner having a volume average particle size of 5 μm to 12 μm and a magnetic carrier having a volume average particle size of 30 μm to 80 μm. The developing device 14 develops an electrostatic latent image on the image carrier 12 with the decolorable toner, and as a result a toner image is formed.

A toner concentration sensor for detecting toner concentration of the stored developer is provided in the developing device 14, and the decolorable toner is supplied to the developing device 14 from a toner cartridge according to a detection output of the toner concentration sensor.

The transfer roller 15 is a conductive roller, to which a transfer bias voltage is applied by a high-voltage power supply to have a positive polarity from. The toner image formed on the image carrier 12 is transferred, by the transfer roller 15 that has the transfer bias, onto the recording medium P that is supplied from sheet feeders 32, 33, and 34 and is transported in a predetermined timing by a resist roller 18. The toner image transferred onto the recording medium P is fixed by an image fixing unit 40. Then, the recording medium P is discharged to an external discharged sheet accumulation unit 45 by a sheet discharge roller 31.

The cleaner 16 includes a cleaning blade 16*a* that is in contact with the front surface of the image carrier 12, and causes the cleaning blade 16*a* to scrape and sweep off toner remaining on the image carrier 12 after the transfer. The discharge lamp 17 removes a charge remaining on the surface of the image carrier 12. The image carrier 12 from which the charge is removed is used to form a subsequent electrostatic latent image.

A sheet feeder having a cassette includes the sheet feeder 32 that stores an unused sheet or a reusable sheet by image decolorization (collectively referred to as a usable sheet) P1, and the sheet feeder 33 that stores a used sheet (sheet having a fixed toner image) P2. In addition, the manual sheet feeder 34 that supplies a sheet from the outside of the apparatus is provided.

The selection of these sheet feeders may be set through the operation panel 2*p*, and a sheet is fed from the sheet feeders 32 and 33 by pick-up rollers 321 and 331 and sheet separation/transport rollers 35 and 36, respectively. In addition, a sheet is fed from the manual sheet feeder 34 by a pick-up roller 341.

After a fixed toner image on the used sheet P2 is erased by an image erasing unit 20, the used sheet P2 fed from the sheet feeder 33 is transported to the image forming unit 10 by a transport roller 39 and the resist roller 18, and used for forming an image. A conveying unit to reverse the side of the sheet is provided in the image forming apparatus 1 according to the present embodiment, but not illustrated in the drawings.

Figure 2:
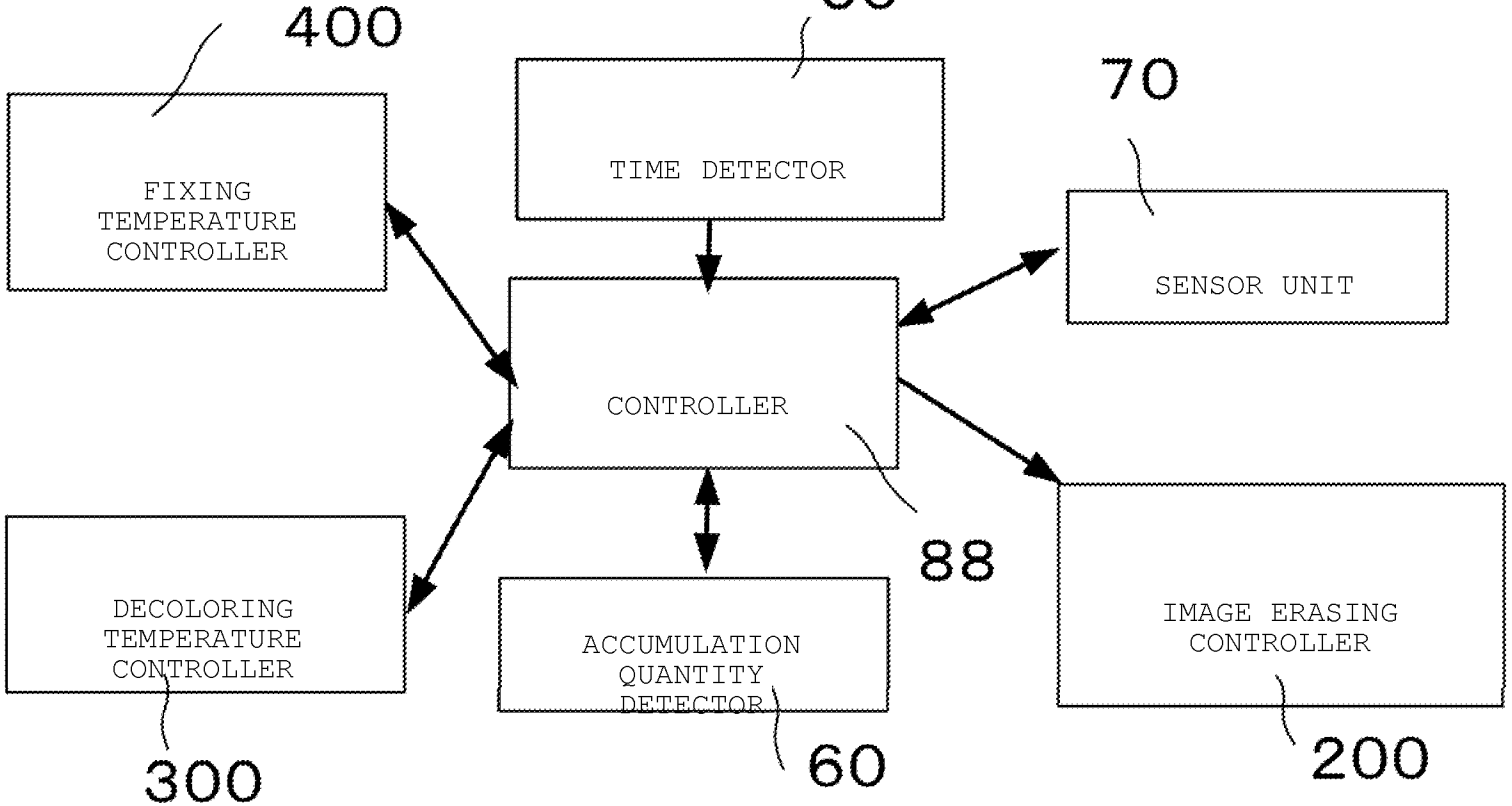
FIG. 2 is a block diagram of a decoloring control system of the image forming apparatus according to the first embodiment.

A main control system of the image forming apparatus 1 is illustrated in FIG. 2. The image forming apparatus 1 includes a time detector 50 that detects that a predetermined time comes, an accumulation quantity detector 60 that detects a quantity of the stored used sheets P2, a sensor unit 70 that detects a peripheral condition around the image forming apparatus 1, an image erasing controller 200 that erases an image on the used sheet P2 under a predetermined condition, a decoloring temperature controller 300 that controls a decoloring (erasing of an image) temperature for the used sheet P2, a fixing temperature controller 400 that controls a fixing temperature, and a controller 88 that controls the entire system.

The used sheet P2 is stored in the sheet feeder 33. When the time preset by the time detector 50 comes, the image erasing unit 20 is operated and an image erasing (decoloring) process is performed on the used sheets P2 stored in the sheet feeder 33 one by one, and the sheets subjected to the image erasing process are discharged from the sheet discharge roller 31 through a transport route, and stacked on the discharged sheet accumulation unit 45.

Image Erasing Unit 20

The image erasing unit 20 is controlled by the image erasing controller 200. The image erasing controller 200 causes the image erasing unit 20 to operate when the time detector 50 detects that the predetermined time comes. The image erasing unit 20 includes a heating unit that includes a first heating roller 21 and a second heating roller 22. The first heating roller 21 serves as a first member that heats a side (hereinafter, also referred to as "image side") on which a toner image is formed on the pre-used sheet P2 has a diameter of 40 mm, and has a halogen lamp 23 as an inside heat source, The second heating roller 22 serves as a second member that heats a side opposite to the image side (hereinafter, also referred to as "pressurized side"), has a diameter of 40 mm, has a halogen lamp 24 as a heat source similar to the first heating roller 21, and is in press contact with the first heating roller 21. A length of a nip formed between the first heating roller 21 and the second heating roller 22 is about 10.8 mm, and a time during which the sheet passes the nip is about 0.08 seconds.

On the first heating roller 21 and the second heating roller 22, temperature sensors (thermistors) 30*a* and 30*b* that measure temperatures of surfaces thereof are provided, respectively. The temperature sensors 30*a* and 30*b* output detected information to the decoloring temperature controller 300. The decoloring temperature controller 300 controls a value of a current supplied to the halogen lamps 23 and 24, based on the input information, such that the surface temperatures of the first heating roller 21 and the second heating roller 22 become a predetermined temperature.

Here, the predetermined temperature is a temperature preset in a range of a decoloring start temperature to an offset start temperature of the decolorable toner. The preset temperature is randomly set in terms of decoloring stability and offset of the decolorable toner. In addition, it is preferable that the first heating roller 21 and the second heating roller 22 be set to substantially the same temperature, for a similar reason. Specifically, when decolorable toner has the decoloring start temperature of 90° C., the surface temperatures of the first heating roller 21 and the second heating roller 22 are controlled to be 120° C.

Figure 3:
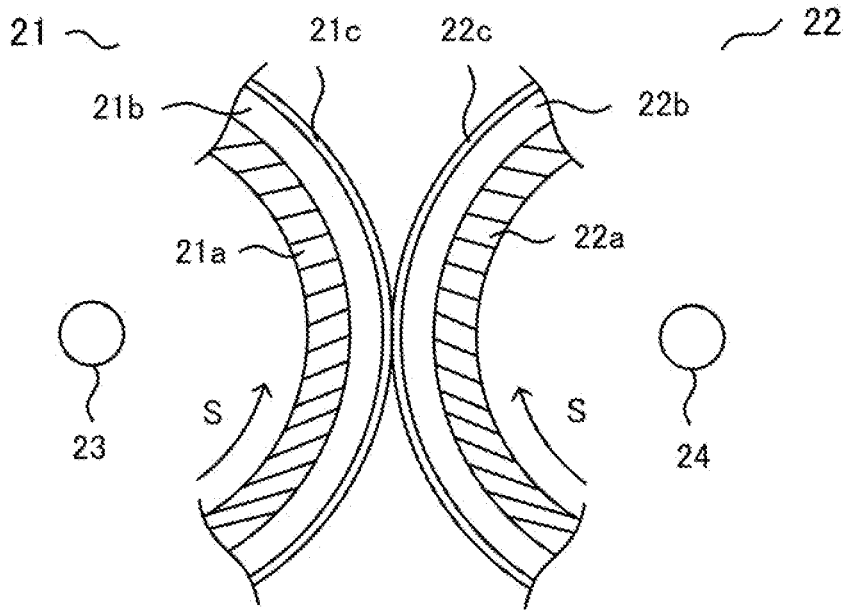
FIG. 3 is a partial cross-sectional view of a heating member in an image erasing unit of the decoloring apparatus according to the first embodiment.

An enlarged view of the first heating roller 21 and the second heating roller 22 is illustrated in FIG. 3. The first heating roller 21 that heats the image side includes a silicone rubber layer having a thickness of about 1.2 mm as an elastic layer 21*b* on an aluminum roller base 21*a* having a thickness of about 1.5 mm, and a fluororesin PFA (tetrafluoroethylene/perfluoroalkyl vinyl ether copolymer) layer of about 30 μm as a release layer 21*c*.

Similarly, the second heating roller 22, which is a second member to heat the pressurized side, includes a silicone rubber layer having a thickness of about 1.2 mm as an elastic layer 22*b* on an aluminum roller base 22*a* having a thickness of about 1.5 mm, and a fluororesin PFA layer of about 30 μm as a release layer 22*c*. The first heating roller 21 is driven by a drive source, and the second heating roller 22 follows the rotation of the first heating roller 21 (FIG. 1 and FIG. 3; arrow S)

The elastic layer 22*b* may not be provided on the second heating roller 22. The elastic layer 22*b* is particularly effective when the used sheets P2, each having a toner image on one side thereof, are stored in the sheet feeder 33 randomly with respect to the side thereof, or when the used sheet P2 that has toner images on both sides is stored in the sheet feeder 33.

Image Fixing Unit 40

The image fixing unit 40 has a function of fixing a transferred image on the recording medium P, and includes a heating roller 42 that heats the image side of the usable sheet P1 and a pressure roller 43 that presses the rear surface of the usable sheet P1. A halogen lamp 44 is disposed inside the pressure roller 43. The image fixing unit 40 is controlled by the fixing temperature controller 400.

The image fixing unit 40 includes the heating roller 42 that has a diameter of 45 mm and has the halogen lamp 41 as a heat source inside thereof and the pressure roller 43 that is in pressure contact with the recording medium P at a side opposite to the toner image side of the recording medium P. The heating roller 42 serves as a third member that heats a side of the recording medium P on which an unfixed toner image is formed.

A temperature sensor (thermistor) 30*c* and a temperature sensor (thermistor) 30*d*, which measure surface temperatures of the heating roller 42 and the pressure roller 43, are provided on the heating roller 42 and the pressure roller 43, respectively. The temperature sensor 30*c* and the temperature sensor 30*d* output the detected temperature information to the fixing temperature controller 400.

The fixing temperature controller 400 controls a current supplied to the halogen lamps 41 and 44, based on the input information, such that the surface temperatures of the heating roller 42 and the pressure roller 43 become a predetermined temperature.

Here, the predetermined temperature is a temperature preset in a range between a lower limit fixing temperature and a decoloring start temperature of the decolorable toner. The preset temperature is randomly set in terms of decoloring characteristics and fixing characteristics of the decolorable toner.

Figure 4:
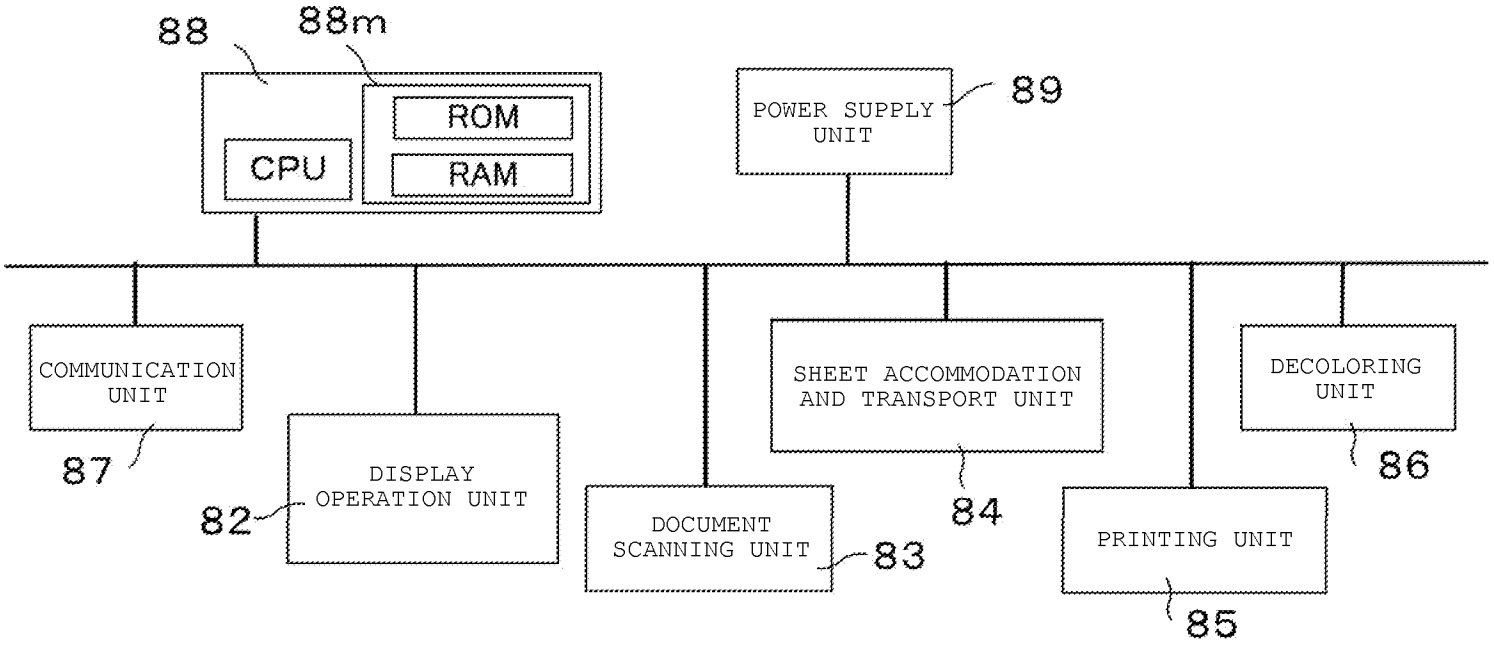
FIG. 4 is a block diagram of an entire control system of the decoloring apparatus according to the first embodiment.

Here, an entire electrically connected configuration of the image forming apparatus is illustrated in FIG. 4. The image forming apparatus 1 includes a display operation unit 82 that has the operation panel 2*p*, a document scanning unit 83 that supplies an original document sheet and performs scanning, a sheet accommodation and transport unit 84 that performs accommodation and transportation of the sheet, a printing unit 85 that forms a latent image and performs transferring and fixing of the toner image, a decoloring unit 86 that performs the decoloring process under a predetermined condition when the sheet is a used sheet, a communication unit 87 that performs communication through a network, a controller 88 that controls these units as a whole, and a power supply unit 89 of the apparatus.

The document scanning unit 83 includes the ADF 3 and the scanner 4 in FIG. 1. The sheet accommodation and transport unit 84 corresponds to the sheet feeders 32 and 33 that store a sheet, and a transport roller or the like that performs transportation during printing.

The printing unit 85 includes the image forming unit 10, the developing device 14, and the image fixing unit 40 in FIG. 1. The decoloring unit 86 includes the time detector 50, the accumulation quantity detector 60, and the sensor unit 70 illustrated in FIG. 2, in addition to the image erasing unit 20. The controller 88 includes a processor (CPU) and a memory unit 88*m*, and the memory unit 88*m* includes a read-only memory (ROM) and a random access memory (RAM). The power supply unit 89 is turned off when the image forming apparatus 1 is shut down by an operator or when a predetermined time elapses after a normal operation has been finished.

Figure 5:
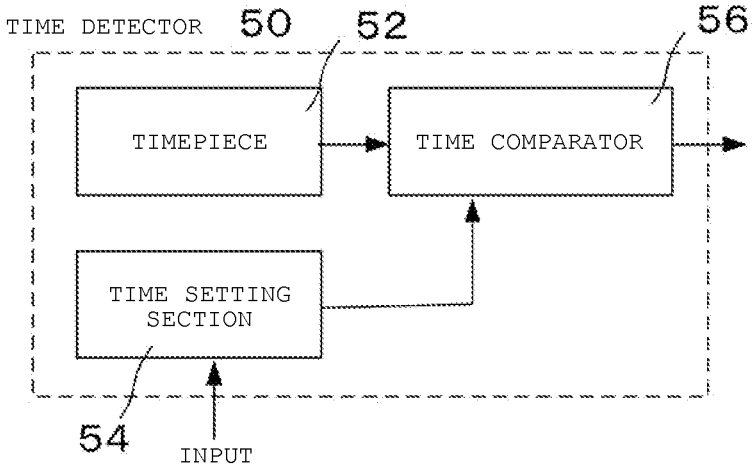
FIG. 5 illustrates a time detector of the decoloring apparatus according to the first embodiment.

Here, each component illustrated in FIG. 2 is described further. Configuration of the time detector 50 is illustrated in FIG. 5. The time detector 50 includes a clock 52 that shows current time, a time setting section 54 on which time to perform the decoloring process may be set through an external operation, and a time comparator 56 that compares the current time from the clock 52 with the time set by the time setting section 54, and outputs a predetermined time detection signal when the set time comes.

The setting of the predetermined time on the time setting section 54 is performed by direct inputting of time through the operation panel 2*p* illustrated in FIG. 1 by an operator, or by causing the current time to be displayed and to be changed up and down from the current time and then determining the set time. It is possible to suppress electricity charge when the set time is in the middle of night when the electricity rate is lower.

Figure 6:
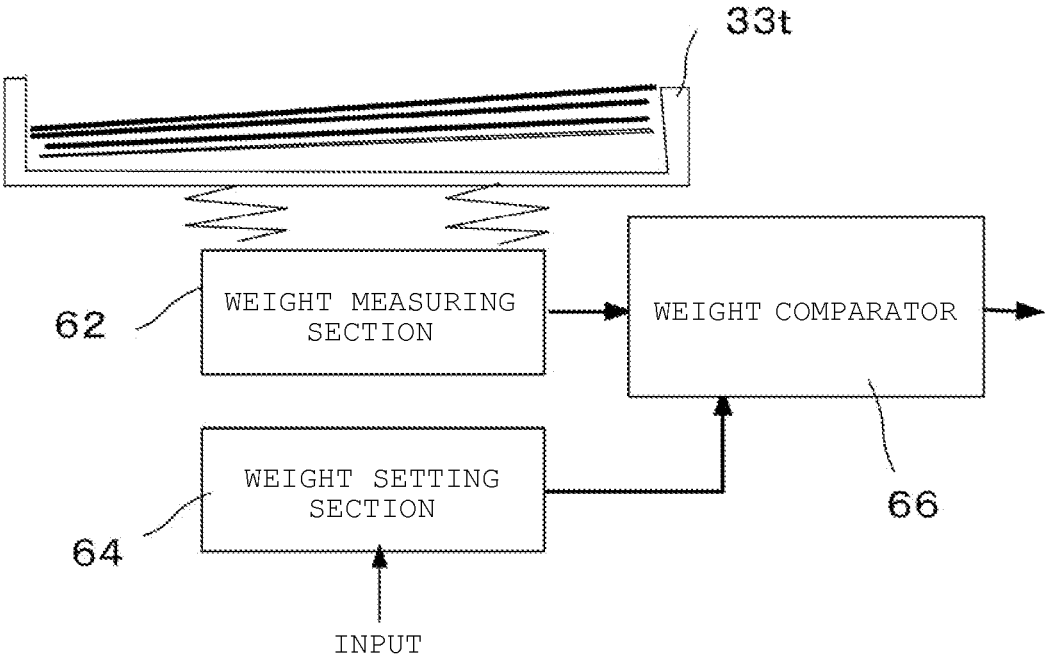
FIG. 6 illustrates an accumulation quantity detector of the decoloring apparatus according to the first embodiment.

FIG. 6 illustrates configuration of the accumulation quantity detector 60 that determines whether or not a predetermined amount of the used sheets P2 are stacked. The accumulation quantity detector 60 includes a weight measuring section 62 that measures the weight of a tray 33*t*, a weight setting section 64 on which an operator inputs and sets a quantity of the used sheets in advance, and a weight comparator 66 that compares the set weight and the measured weight of the used sheets P2 measured by the weight measuring section 62.

The accumulation quantity detector 60 measures weight of the used sheets by subtracting the self-weight of the tray 33*t* from weight of the tray 33*t* on which the used sheets P2 are stacked, that is, a total weight of the used sheets P2 and the tray 33*t*. It is determined whether or not a predetermined quantity or more of the used sheets are stacked by comparing the measured weight with the predetermined value set in advance to perform the decoloring process.

The accumulation quantity detector 60 may not detect the weight of the used sheets that is to be decolorized, rather may measure a thickness of the stacked sheets by using, for example, an optical sensor, and calculate the number of sheets by converting the thickness into the number of sheets. When the number of sheets is set, the calculated number of sheets is compared to the number that is input and set in advance, and it is determined whether the predetermined number or more of the used sheets are stacked.

Figure 7:
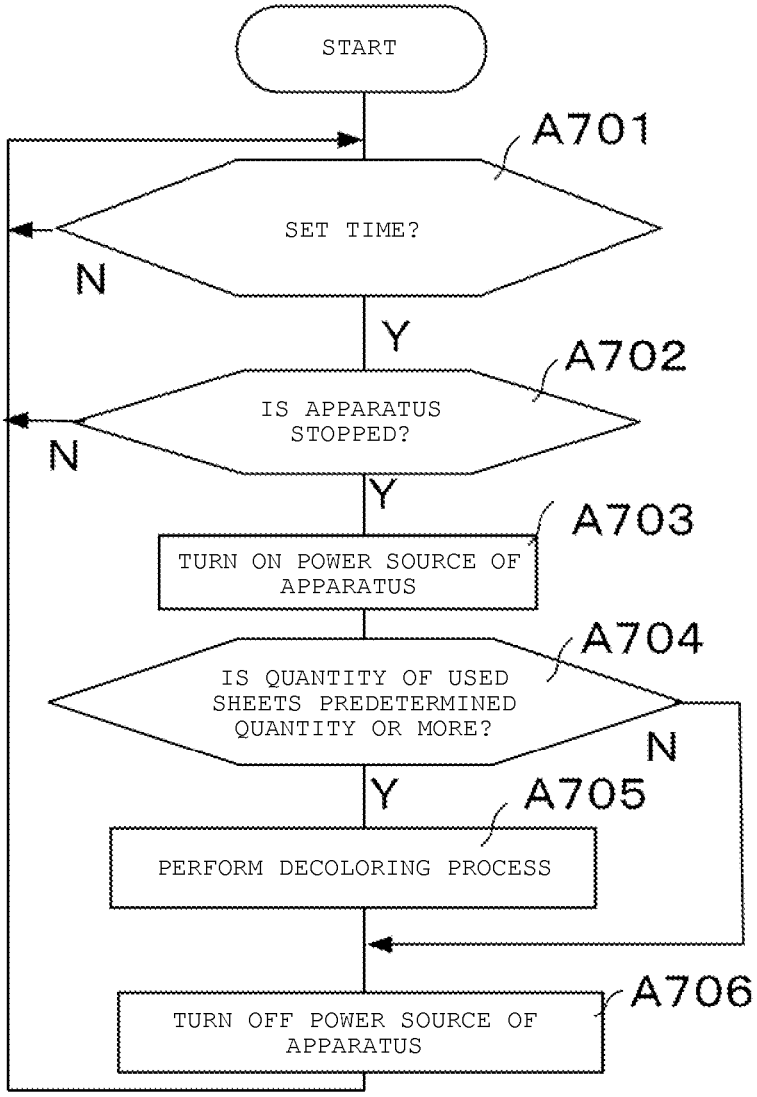
FIG. 7 is a flowchart of an operation carried out by the decoloring apparatus according to the first embodiment.

An operation according to the embodiment is described with reference to a flowchart illustrated in FIG. 7. The above-described image forming apparatus 1 normally uses the usable sheet P1, that is, unused or reusable sheet, which is stored in the sheet feeder 32. An image formed by the image forming unit 10 is transferred, fixed, and printed on the sheet, and then the sheet is stacked on the discharged sheet accumulation unit 45. The used sheets P2 that have been used are stacked in the sheet feeder 33.

The operator set appropriate time in advance as time for the decoloring process in the time setting section 54 of the time detector 50. In the image forming apparatus 1 in which the predetermined time is set by the time setting section 54, it is detected that the time set in the clock 52 comes (A701). It is determined that whether or not the set time comes by the time comparator 56 comparing the current time shown by the clock 52 with the time set by the time setting section 54.

When it is detected that the set time comes (Y in A701), it is determined whether or not the image forming apparatus 1 is currently stopped based on the operation or operation-stop of the power supply unit 89, in following A702. When the image forming apparatus 1 is not stopped (power-off state, minimum required operation) (N in A702), the decoloring process is not performed. Meanwhile, when it is detected that the image forming apparatus 1 is stopped in A702, the power supply unit 89 of the image forming apparatus 1 turns on in following A703, and the apparatus is operated.

It is determined whether or not the predetermined quantity or more of the used sheets P2 are stacked in A704. The quantity is measured by the weight measuring section 62 in FIG. 6. The detection is performed by the weight comparator 66 comparing the weight of the used sheets P2 obtained by subtracting the weight of the tray 33*t* from total weight measured by the weight measuring section 62 with the weight set in advance by the operator in the weight setting section 64.

When it is determined that the predetermined quantity or more of the used sheets P2 are stacked (Y in A704), the decoloring process is collectively performed on the used sheets P2 in A705. Specifically, the image erasing process is performed on the used sheets stacked by the image erasing unit 20 under control of the image erasing controller 200. Then, the power supply unit 89 of the image forming apparatus 1 turns off and no power is supplied except for a power needed for a stand-by operation (A706). Then, the process returns to A701 and is on standby until the set time comes.

When it is determined that less than the predetermined quantity of the used sheets are stacked in A704, the decoloring process is not performed, the image forming apparatus 1 is turned off in A706, and the process returns to A701. That is, even when the predetermined time set to perform the decoloring process comes, the decoloring process is not executed on the used sheets when the predetermined quantity of the used sheets is not stacked.

According to the embodiment, the apparatus is turned off until the preset decoloring start time comes, and the decoloring process is not executed when the used sheets are less than the preset quantity.

According to the embodiment, the operator sets, in advance, time to perform the decoloring process in the time setting section, but the time may also set through setting of termination time of the power-saving mode of the image forming apparatus. Accordingly, while the image forming apparatus is turned on, the decoloring process may be performed on the used sheets subsequent to the printing process.

Second Embodiment

Figure 8:
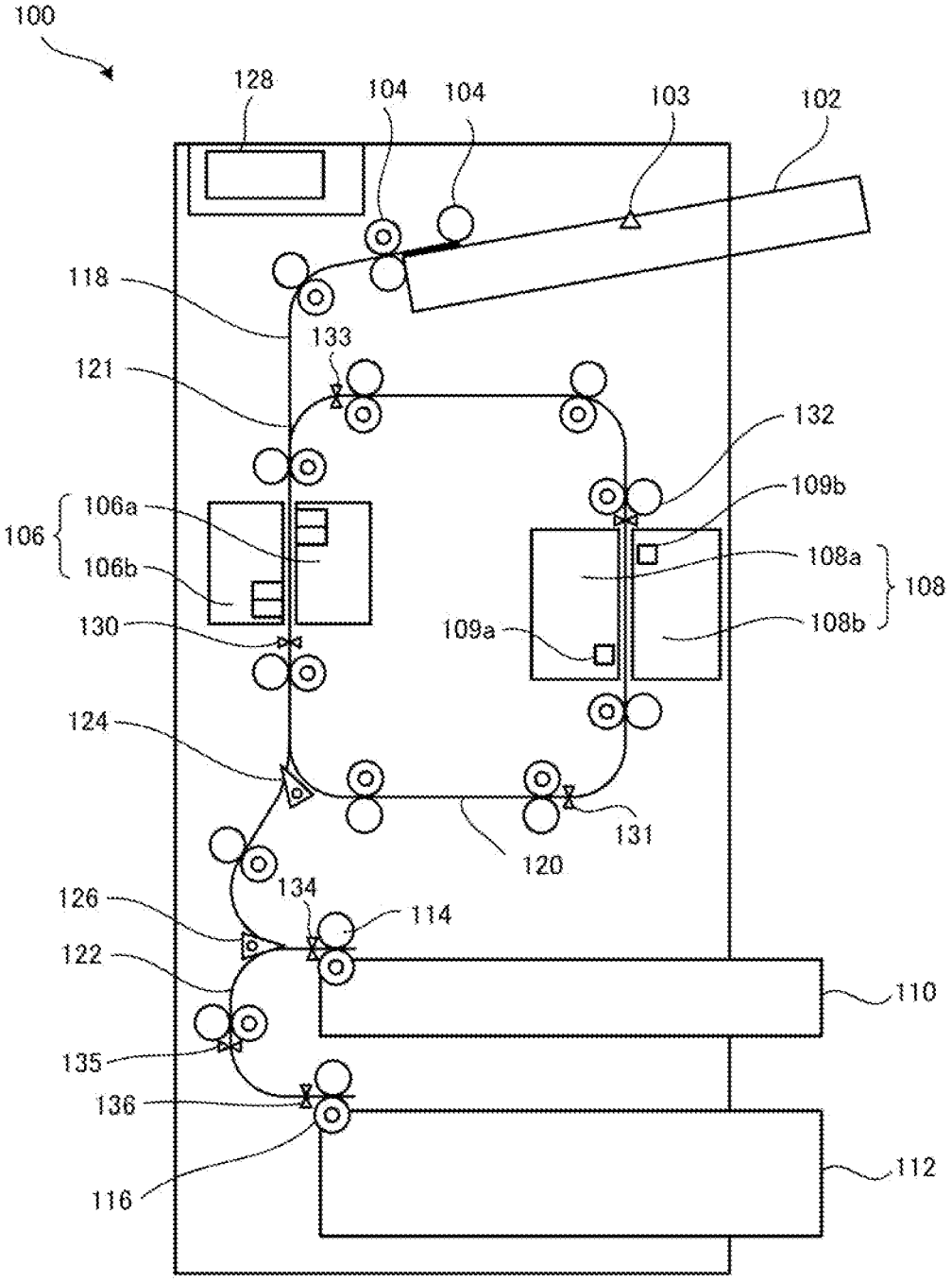
FIG. 8 illustrates a decoloring apparatus according to a second embodiment.

Next, another embodiment as a decoloring apparatus will be described. A configuration of the decoloring apparatus according to a second embodiment is illustrated in FIG. 8.

A decoloring apparatus 100 performs a "decoloring process" in which a color of an image formed with a decolorable color material, such as decolorable toner or decolorable ink, is erased from a sheet.

The decolorable color material contains a coloring compound, a developer, and a decoloring agent. An example of the coloring compound includes leuco dye. Examples of the developer include phenols. An example of the decoloring agent includes a substance that is compatible with the coloring compound when the substance is heated, and that does not have affinity for the developer. The decolorable color material generates color by an interaction between the coloring compound and the developer, and since the interaction between the coloring compound and the developer is cut off through heating to a decoloring temperature or higher, the decolorable color material is decolorized.

The decoloring apparatus 100 includes a sheet feeding tray 102, a sheet feeding member 104, a reading unit 106, a decoloring device 108, a first tray 110, a second tray 112, discharge rollers 114 and 116, a first transport path 118, a second transport path 120, a third transport path 122, a first branch member 124, a second branch member 126, and an operation unit 128.

The sheet feeding tray 102 is loaded with reusable sheets. The sheet feeding tray 102 is loaded with sheets of various sizes, such as A4, A3, B5, or the like. The sheet with which the sheet feeding tray 102 is loaded is a sheet having an imaged formed with a decolorable colorant that is decolorized by being heated to a predetermined temperature or higher. The sheet feeding member 104 includes a pick-up roller, a sheet supply roller, and a separation roller disposed to face the sheet supply roller, and supplies the sheets on the sheet feeding tray 102 one by one to the first transport path 118 inside the decoloring apparatus 100.

In addition, the sheet feeding tray 102 includes a detection sensor 103 that detects presence or absence of a sheet on the sheet feeding tray 102. The detection sensor 103, for example, may be a microsensor or a microactuator. The first transport path 118 is a transport path from the sheet feeding tray 102 toward the first tray 110. The fed sheet is conveyed through the first transport path 118 to the reading unit 106 or the first tray 110.

The reading unit 106 is disposed along the first transport path 118 downstream with respect to the sheet feeding tray 102 in a sheet transport direction. The reading unit 106 is, for example, a charge coupled device (CCD) scanner or a CMOS sensor.

According to the present embodiment, the reading unit 106 reads images on a first surface and a second surface of a sheet that is transported. That is, the reading unit 106 has a first reading unit 106*a* and a second reading unit 106*b* which are disposed along the first transport path 118 between which the transport path is formed, and may read images on both surfaces of the sheet that is transported.

A position where the reading units of the reading unit 106 read images on the sheet is referred to as a reading position. Image data of the image read by the reading unit 106 is stored in a storage unit 210 (see FIG. 9). For example, the image data of the image on the sheet which is read by the reading unit 106, before the decoloring process, is digitalized and stored in the storage unit. When data of the decolorized image is required later, it is possible to output the image data. In addition, a controller 201 determines whether or not the image on the sheet is decolorable, or whether or not the sheet may be reusable, based on the image read by the reading unit 106.

The first branch member 124 as a switching unit is disposed downstream with respect to the reading unit 106. The first branch member 124 switches a transport direction of the sheet. The first branch member 124 guides the sheet that is transported through the first transport path 118 to the second transport path 120 or to the first tray 110. The second transport path 120 starts in a branch point where the first branch member 124 is disposed and where the first transport path 118 branches. The sheet is conveyed through the second transport path 120 that starts from the branch point, to the decoloring device 108.

In addition, the second transport path 120 joins the first transport path 118 at a junction 121 upstream with respect to the reading unit 106 in the sheet transport direction. That is, the second transport path 120 joins the first transport path 118 at a junction 121 between the sheet feeding tray 102 and the reading unit 106.

Thus, the second transport path 120 enables the sheet transported from the reading unit 106 to be transported back to the reading unit 106 through the decoloring device 108. In other words, the decoloring apparatus 100 controls the first branch member 124 to cause the sheet fed from the sheet feeding member 104 to be transported the reading unit 106, the decoloring device 108, and the reading unit 106 in the order.

The first transport path 118 includes a second branch member 126 downstream with respect to the first branch member 124. The second branch member 126 guides the sheet transported from the first branch member 124 to the first tray 110 or to the third transport path 122. The sheet is transported through the third transport path 122 to the second tray 112.

The decoloring device 108 erases a color of the image on the sheet that is transported. For example, in a state in which the decoloring device 108 is in contact with the sheet that is transported, the decoloring device 108 heats the sheet to a predetermined decoloring temperature, thereby performing the decoloring of the image formed on the sheet with the decolorable colorant.

For example, the decoloring device 108 of the decoloring apparatus 100 according to the present embodiment includes two decoloring units 108*a* and 108*b* for decoloring the first and second surfaces of the sheet. The decoloring units 108*a* and 108*b* are disposed to face each other interposing the second transport path 120 therebetween. The decoloring unit 108*a* comes into contact with and heats the sheet from the one surface side of the sheet.

The decoloring unit 108*b* comes into contact with and heats the sheet from the other surface side of the sheet. That is, the decoloring device 108 performs the decoloring of the images on both surfaces of the sheet that is transported, during a single transport. The position where the decoloring units 108*a* and 108*b* heat the sheet, that is, the position where a heating section (not illustrated) that is included in the decoloring units 108*a* and 108*b* provides heat to the sheet and erases a color of the image, is referred to as the decoloring position.

In the decoloring device 108, the decoloring units 108*a* and 108*b* have temperature sensors 109*a* and 109*b*, respectively, each of which detects the temperature of the heating section. The temperature sensors 109*a* and 109*b* may be of a contact type or a non-contact type.

The operation unit 128 disposed on the upper part of a main body of the decoloring apparatus 100 includes a touch panel display section and various operation keys, which are, for example, disposed on the upper part of the decoloring apparatus main body. The operation keys include, for example, a numeric keypad, a stop key, and a start key. A user instructs a functional operation of the decoloring apparatus 100, such as a decoloring start or reading of the image of the sheet on which the decoloring process is performed, through the operation unit.

The operation unit 128 displays setting information or operational status, or log information of the decoloring apparatus 100, or an message to the user.

The discharge rollers 114 and 116 discharge the sheet to the first tray 110 and the second tray 112, respectively, which are disposed vertically on the lower part of the main body. The second tray 112 is loaded with unused sheets or reusable sheets on which the decoloring process is performed. For example, the reusable sheet on which the image remains and the decoloring process is performed is loaded in the first tray 110. When a predetermined time comes, the used sheet loaded in the first tray 110 is transported from the first tray 110, and collectively decolorized by the decoloring device 108 and stacked onto the second tray 112. Thus, the discharge roller 114 is also capable of rotating reversely, and not only the sheet passed through the reading unit 106, but also the used sheet temporarily stored in the first tray 110 is transported from the first tray 110 to the second transport path 120 and passes through the decoloring device 108.

According to the embodiment, the used sheets stored in the first tray 110 and the used sheets stored in the sheet feeding tray 102 pass through the decoloring device 108, and thus it is possible to perform the decoloring process on the sheets. The quantity of the used sheets may be the sum of quantities of the sheets in the first tray 110 and in the sheet feeding tray 102.

Here, the first tray 110 is described as a reuse tray for reusable sheets, and the second tray 112 is described as a tray of usable sheets. The sheets stored in the first tray 110 and the second tray 112 may be switched.

Figure 9:
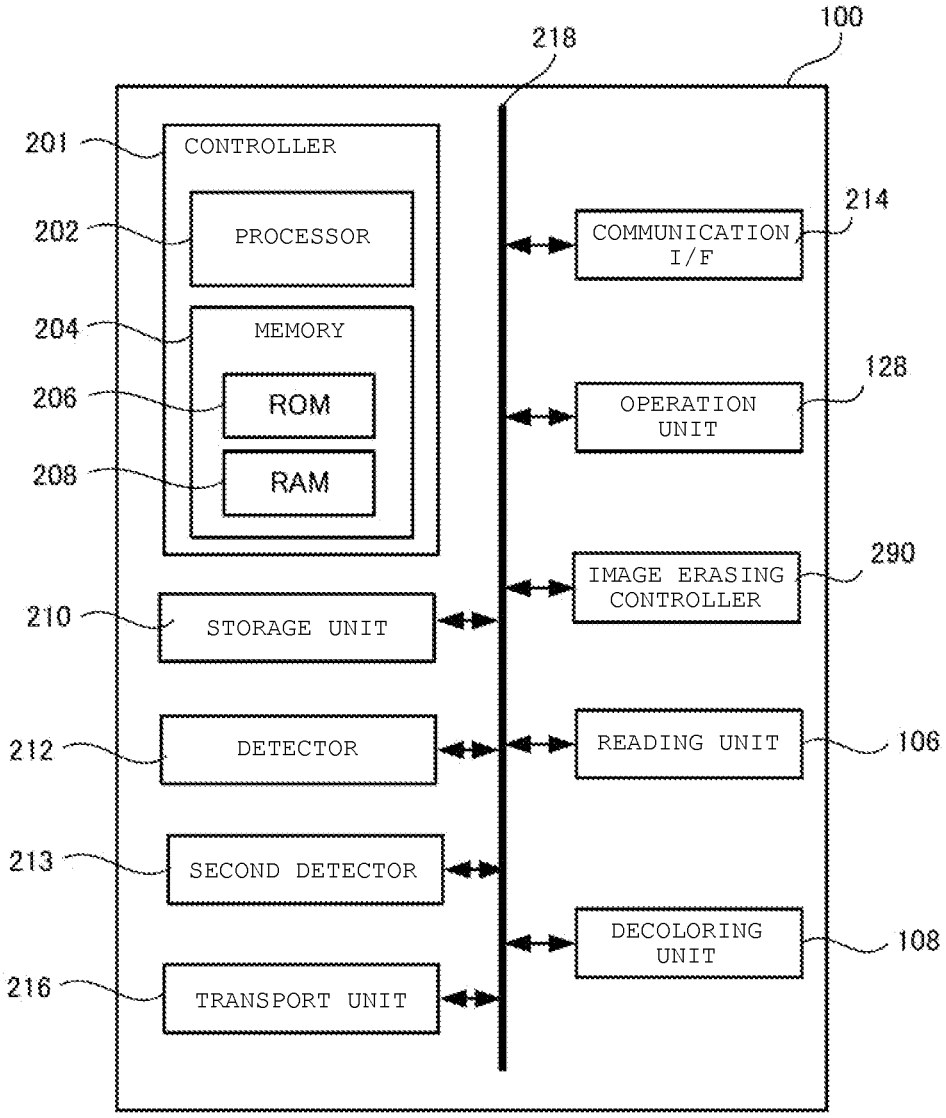
FIG. 9 is a block diagram of a control system of the decoloring apparatus according to the second embodiment.

FIG. 9 is a block diagram of a functional units of the decoloring apparatus 100. The decoloring apparatus 100 includes a controller 201, a storage unit 210, a detector 212, a second detector 213, a communication interface (communication I/F) 214, a transport unit 216, the reading unit 106, the decoloring device 108, the operation unit 128, and an image erasing controller 290. Each component of the decoloring apparatus 100 is connected through a bus 218. The second detector 213 includes a time detector 250, an accumulation quantity detector 260, a sensor unit 270, and an apparatus operation detector 280 (see FIG. 12 to be described later).

The controller 201 includes a processor 202 that includes a central processing unit (CPU) or a micro processing unit (MPU), and a memory 204. The controller 201 controls the reading unit 106, the decoloring device 108, and the operation unit 128.

The memory 204 is, for example, a semiconductor memory, and includes a read-only memory (ROM) 206 that stores various control programs, and a random access memory (RAM) 208 that provides the processor 202 with a temporary operation region. For example, the ROM 206 stores a printing ratio that is a threshold value for determining whether a sheet is reusable or not, a concentration threshold value for determining whether or not an image on a sheet is decolorized, or the like. The RAM 208 may temporarily retain the image data generated by the reading unit 106.

The decoloring apparatus 100 has, for example, a reading process, a decoloring process, and classifying process. The controller 201 of the decoloring apparatus 100 controls the reading unit 106, the decoloring device 108, and other configurations according to the set process.

In the reading process, the controller 201 controls the first reading unit 106*a* and the second reading unit 106*b* to read the images that are printed on both surfaces of the sheet. The controller 201 retains the image data generated by the reading unit 106 in the storage unit 210 (see FIG. 9).

In the decoloring process, the controller 201 controls the decoloring device 108 to erase the images on the sheet. That is, the images printed on both surfaces of the sheet are erased by the decoloring units 108*a* and 108*b* of the decoloring device 108.

In the classifying process, the controller 201 determines where the sheet is conveyed to the first tray 110 or to the second tray 112 depending on the presence or absence of an image on the sheet. The controller 201 determines whether or not an image is present, based on the image data generated by the reading unit 106. When an image is present, the sheet is conveyed to the first tray 110. When the image data generated by the reading unit 106 indicates that the image on the sheet is erased by the decoloring device 108, the sheet is conveyed to the second tray 112.

Figure 12:
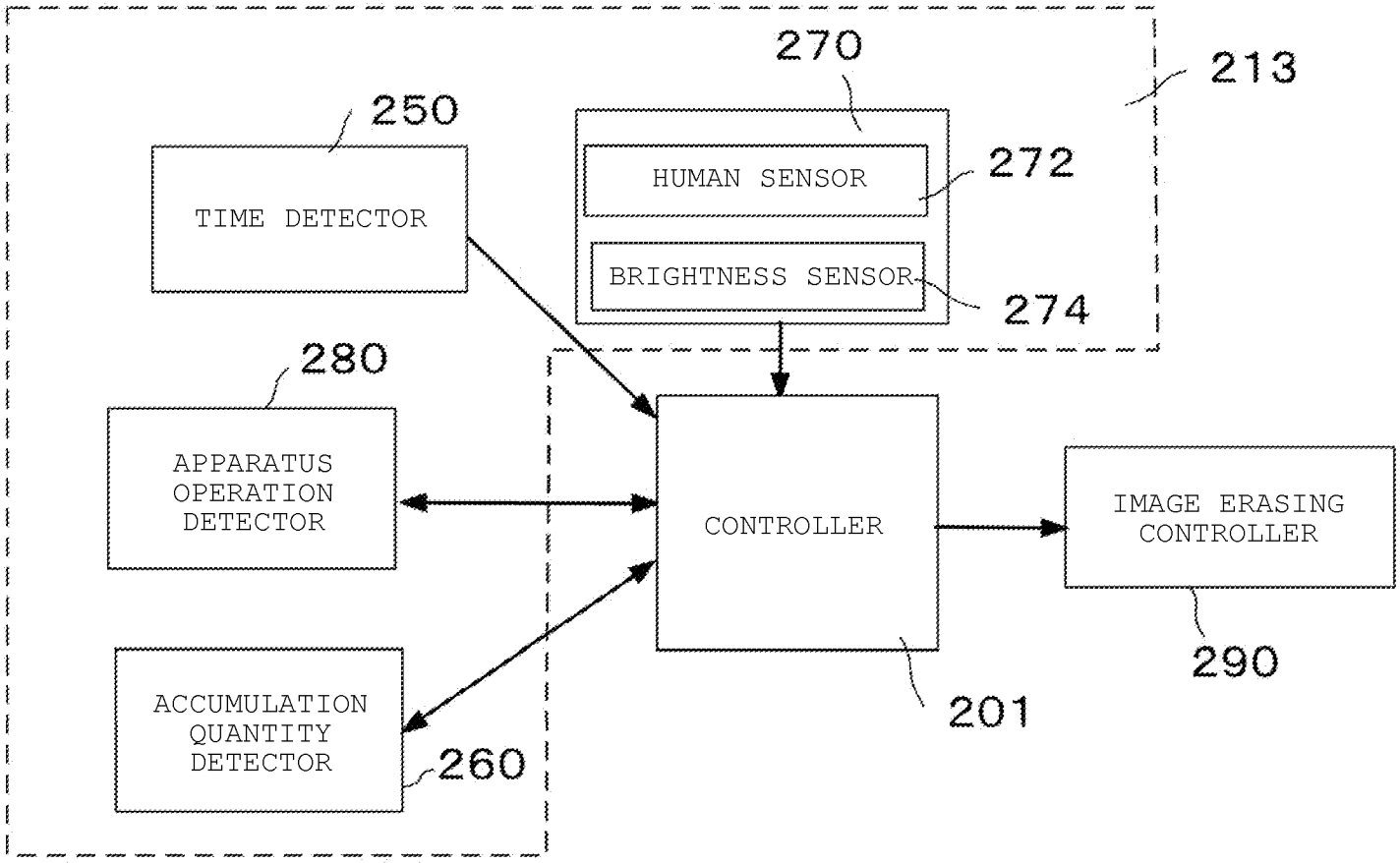
FIG. 12 illustrates a relation between a second detection unit, a controller, and an image erasing controller of the decoloring apparatus according to the second embodiment.

Configuration of the second detector 213 and a relation between the controller 201 and the image erasing controller 290 are illustrated in FIG. 12. The second detector 213 includes the time detector 250, the accumulation quantity detector 260, the sensor unit 270, and the apparatus operation detector 280.

Figure 10:
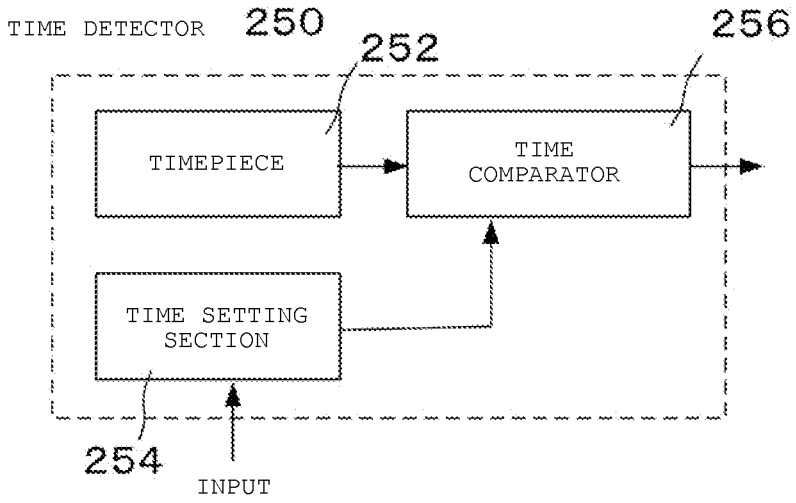
FIG. 10 illustrates a time detector of the decoloring apparatus according to the second embodiment.

As illustrated in FIG. 10, the time detector 250 includes a clock 252 that tells current time, a time setting section 254, and a time comparator 256. Appropriate time to perform the decoloring process is set on the time setting section 254 by an operator through an external operation. The time comparator 256 compares the current time shown by the clock 252 with the time of the time setting section 254, and when the set time comes a decoloring instruction control signal is output.

Figure 11:
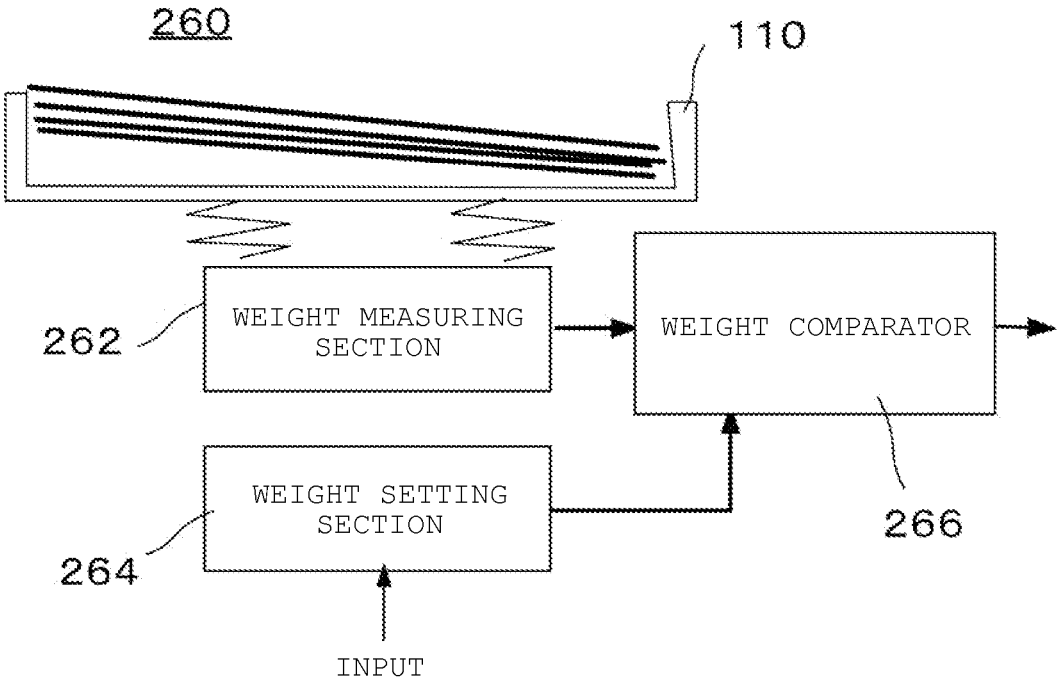
FIG. 11 illustrates an accumulation quantity detector of the decoloring apparatus according to the second embodiment.

As illustrated in FIG. 11, the accumulation quantity detector 260 detects the quantity of accumulation of the used sheets by measuring the weight of the used sheets. The accumulation quantity detector 260 is configured to have a weight measuring section 262 that detects the weight of the used sheets in the first tray 110, a weight setting section 264 in which the weight of the used sheets is set, and a weight comparator 266.

The sensor unit 270 includes a human sensor (motion detector) 272 that detects that a person is present near the human sensor 272, and a brightness sensor 274 that detects the brightness around the decoloring apparatus 100. The human sensor 272 may be a sensor that detects motion of an object. In addition, the brightness sensor 274 may compare luminance with a predetermined threshold value, and determines whether it is bright or dark. The detection by these human sensor and brightness sensor may be applied to the first embodiment in a similar manner.

The controller 201 controls each configuration inside the apparatus, based on a signal from the detector 212. The detector 212 includes the detection sensor 103 illustrated in FIG. 1, the temperature sensors 109*a* and 109*b*, sheet detection sensors 130 to 136, and a detection sensor that detects the quantity of the sheets in the first tray 110 and the second tray 112. The controller 201 determines the presence or absence of the sheet on the sheet feeding tray 102 based on a signal from the detection sensor 103.

In addition, the controller 201 recognizes temperatures of the heating sections of the decoloring units 108*a* and 108*b* using the temperature sensors 109*a* and 109*b*, and controls the temperatures of the heating sections of the decoloring units 108*a* and 108*b*. In addition, the controller 201 recognizes a position of the sheet in the first to third transport paths 118, 120, and 122, using the sheet detection sensors 130, 131, 132, 133, 134, 135, and 136. For example, the controller 201 recognizes the sheet that passed the reading unit 106 by using the sheet detection sensor 130 in the vicinity of the downstream with respect to the reading unit 106.

The storage unit 210 stores an application program and an OS. The application program includes a program to achieve a function that the decoloring apparatus 100 has, such as a reading function by the reading unit 106, and a decoloring function of the decoloring unit. The application program further includes an application (Web browser) for a Web client or other applications.

The storage unit 210 retains the image data generated by the reading unit 106. In addition, the storage unit 210 stores the number of sheets processed by the decoloring apparatus 100. Examples of the storage unit 210 may be a hard disk drive or other magnetic storage devices, an optical storage device, a semiconductor memory device, such as a flash memory, or any combination thereof.

The communication I/F 214 is an interface to connect the decoloring apparatus 100 to an external device. The communication I/F 214 communicates with an external apparatus on a network via an appropriate wireless or wired access, such as Bluetooth (registered trademark), an infrared access, an optical access, for example, IEEE802.15, IEEE802.11, IEEE802.3, IEEE3304. The communication I/F 214 may further include a USB connector to which a connection terminal compatible with a USB standard is connected, a parallel interface, or the like.

The transport unit 216 includes a plurality of transport rollers that are disposed on the first transport path 118, the second transport path 120, and the third transport path 122, and a transport motor that drives the transport roller. The controller 201 controls the drive of the transport motor of the transport unit 216 so as to control a transport speed of sheets.

Here, a speed of a sheet conveyed through the reading unit 106 so that an image on the sheet is read is referred to as a reading speed, and a speed of a sheet conveyed through the decoloring device 108 so that a color of an image on the sheet is erased is referred to as a decoloring speed.

Next, a loading unit of the decoloring apparatus 100 will be described. The loading unit includes the first tray 110, which is a reuse tray in which the used sheet to be subject to the decoloring process is stored, and the second tray 112 in which the usable sheet is stored. The unused sheet that is usually used or the sheet on which the decoloring process has been performed is stored in the second tray 112. The sheet stored in the first tray 110 is subject to the decoloring process by the decoloring device 108.

Figure 13:
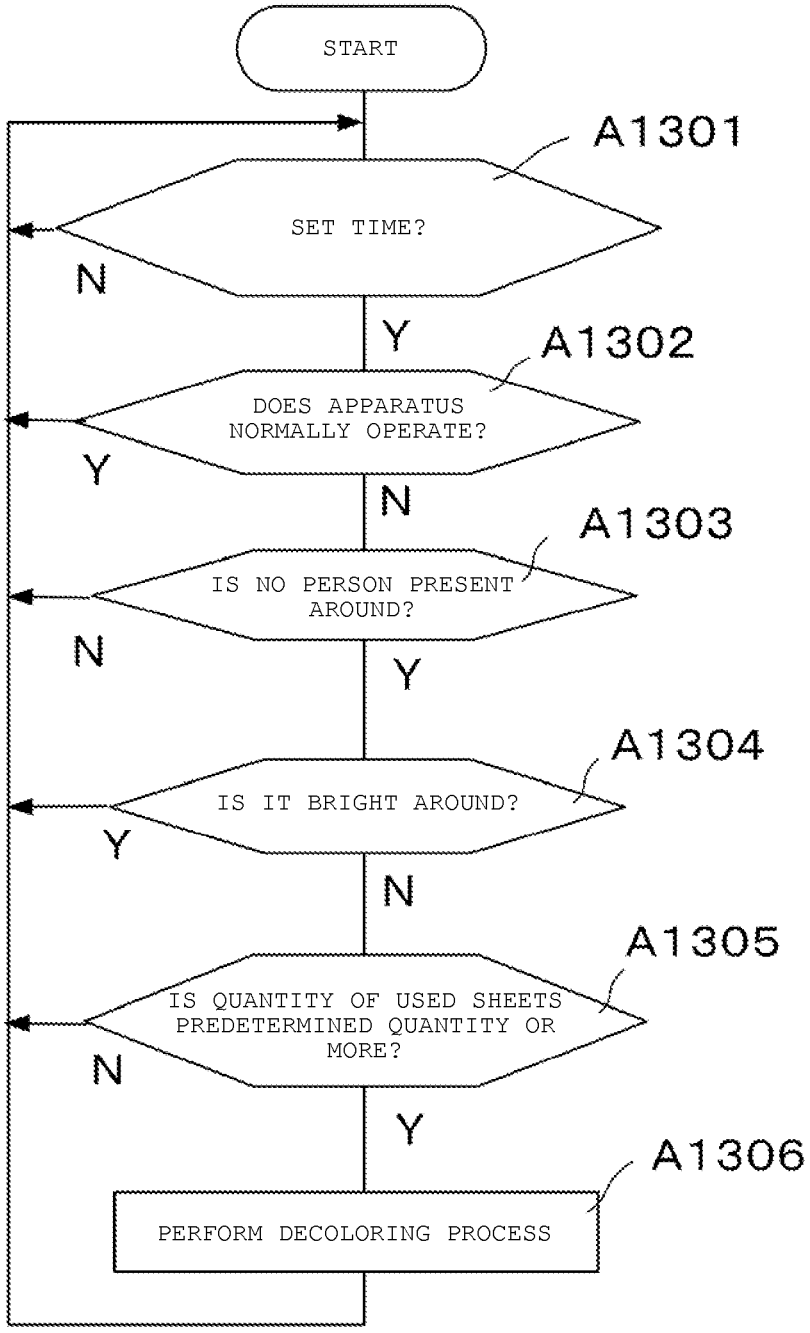
FIG. 13 is a flowchart of an operation carried out by the decoloring apparatus according to the second embodiment.

Next, an image erasing operation according to the second embodiment is described based on a flowchart illustrated in FIG. 13. When the scheduled decoloring time preset to perform the decoloring process comes (Y in A1301), a control signal indicating that the time has come is transmitted to the controller 201 from the time detector 250. When the controller 201 receives a scheduled decoloring time control signal, first, in A1302, a question whether the decoloring apparatus 100 is normally operated is transmitted to the apparatus operation detector 280 (A1302). When the decoloring apparatus 100 is normally operated, the process is on standby until the following set time.

When the decoloring apparatus 100 is not normally operated (N in A1302), the controller 201 transmits a signal of a question whether or not there is a person around the human sensor 272 of the sensor unit 270. When there is a person around (N in A1303), the process returns to A1301 and is on standby until the following set time.

Meanwhile, when there is no person therearound (Y in A1303), the controller 201 transmits a question of the brightness around the decoloring apparatus 100 to the brightness sensor 274 of the sensor unit 270.

When it is bright around (Y in A1304), it is highly probable that there is a person around. Therefore, the process returns to A1301 and is on standby until the following decoloring set time. Meanwhile, when it is dark around the apparatus (N in A1304), the process proceeds to the following A1305. In A1305, the controller 201 controls the accumulation quantity detector 260 to detect whether the preset quantity or more of the used sheets are stacked on the first tray 110.

When the preset quantity or more of the used sheets are stacked (Y in A1305), the controller 201 transmits the image erasing instruction signal to the image erasing controller 290, and erasing (decoloring) of the image is performed by the decoloring device 108. Meanwhile, when less than the predetermined quantity of the used sheets are stacked (N in A1305), the process returns to A1301 and is on standby until the following set time for the decoloring process.

According to the embodiment, when the decoloring set time comes, the decoloring apparatus 100 stops normal operation. When there is no person around, it is dark around, and the predetermined quantity of the used sheets is stacked, the image erasing operation is performed. It is possible to stop the decoloring process when at least one condition of the human sensor and the brightness sensor is not met. For example, when the human sensor detects a person around, the decoloring process is not performed even at the predetermined time. Alternatively, when the brightness sensor detects a predetermined brightness around, the decoloring process is not performed even at the preset time.

According to above-described embodiments, the used sheets are subject to the decoloring process, but the technology may be applied to any used medium that may be printed decolorably other than the sheets.

According to the above-described embodiment, a document decoloring management apparatus and a decoloring management method are obtained, in which it is possible to efficiently erase an image on a sheet, such as a document, on which printing is performed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A decoloring apparatus comprising:

an erasing unit configured to generate heat so as to erase an image formed on a sheet with an erasable material;

a sheet storing unit to store one or more sheets, each having the image formed thereon with the erasable material;

a sheet conveying unit configured to convey the sheets from the sheet storing unit to the erasing unit;

a sensor configured to detect an amount of the sheets stored in the sheet storing unit;

a motion detector; and a control unit configured to determine whether or not the detected amount is greater than a predetermined value, and to control the sheet conveying unit to convey the sheets and the erasing unit to generate heat, responsive to determining that the motion detector has not detected a moving object for a predetermined length of time and the detected amount is greater than the predetermined value.

2. The decoloring apparatus according to claim 1, wherein the amount is a weight of the sheets stored in the sheet storing unit.

3. The decoloring apparatus according to claim 1, wherein the control unit is configured to carry out the controlling of the sheet conveying unit and the erasing unit only at a predetermined time of day.

4. The decoloring apparatus according to claim 3, wherein the predetermined time of day is during the night.

5. The decoloring apparatus according to claim 1, further comprising:

a brightness sensor configured to detect brightness around the decoloring apparatus, wherein the control unit is further configured to determine whether or not the detected brightness is smaller than a predetermined value, and to carry out the controlling of the sheet conveying unit and the erasing unit when the control unit determines that the detected brightness is smaller than the predetermined value.

6. The decoloring apparatus according to claim 1, wherein the control unit is further configured to determine an operational mode of the decoloring apparatus, the operational mode including a normal mode and a stand-by mode during which energy consumption of the decoloring apparatus is smaller than during the normal mode, and to carry out the controlling of the sheet conveying unit and the erasing unit in the stand-by mode and not in the normal mode.

7. The decoloring apparatus according to claim 1, further comprising:

a storage unit, wherein the control unit is further configured to receive a user input for setting the predetermined value, and control the storage unit to store the predetermined value according to the user input.

8. A method for operating a decoloring apparatus including an erasing unit, a sheet storing unit storing one or more sheets, each having an image formed with an erasable material, and a sheet conveying unit, the method comprising:

carrying out a detection process to detect a moving object around the decoloring apparatus;

detecting an amount of sheets in the sheet storing unit; and controlling the sheet conveying unit to convey the sheets in the sheet storing unit to the erasing unit, and the erasing unit to generate heat so as to erase the image on each of the sheets, when the detection process has not detected the moving object for a predetermining length of time and the detected amount is greater than a predetermined value.

9. The method according to claim 8, wherein the amount is a weight of the sheets stored in the sheet storing unit.

10. The method according to claim 8, wherein the controlling of the sheet conveying unit and the erasing unit is carried out only at a predetermined time of day.

11. The method according to claim 10, wherein the predetermined time of the day is during the night.

12. The method according to claim 8, further comprising:

detecting brightness around the decoloring apparatus; and determining that the detected brightness is smaller than a predetermined value, wherein the controlling of the sheet conveying unit and the erasing unit is carried out when the detected brightness is smaller than the predetermined value.

13. The method according to claim 8, further comprising:

determining an operational mode of the decoloring apparatus, the operational mode including a normal mode and a stand-by mode during which energy consumption of the decoloring apparatus is smaller than during the normal mode, wherein the controlling of the sheet conveying unit and the erasing unit is carried out only when the decoloring apparatus is in the stand-by mode and not in the normal mode.

14. The method according to claim 8, further comprising:

receiving a user input for setting the predetermined value; and storing the predetermined value according to the user input.

15. A non-transitory computer readable medium comprising a program that is executable in a computing device to cause the computing device to perform a method for operating a decoloring apparatus, the method comprising:

carrying out a detection process to detect a moving object around the decoloring apparatus;

detecting an amount of sheets in a sheet storing unit for storing one or more sheets having an image formed with an erasable material; and controlling a sheet conveying unit to convey the sheets in the sheet storing unit to an erasing unit, and the erasing unit to generate heat so as to erase the image on each of the sheets, when the detection process has not detected the moving object for a predetermined length of time and the detected amount is greater than a predetermined value.

16. The non-transitory computer readable medium according to claim 15, wherein the amount is a weight of the sheets stored in the sheet storing unit.

17. The non-transitory computer readable medium according to claim 15, wherein the controlling of the sheet conveying unit and the erasing unit is carried out only at a predetermined time of day.

18. The non-transitory computer readable medium according to claim 17, wherein the predetermined time of the day is during the night.

19. The non-transitory computer readable medium according to claim 15, wherein the method further comprises:

detecting brightness around the decoloring apparatus; and determining that the detected brightness is smaller than a predetermined value, wherein the controlling of the sheet conveying unit and the erasing unit is carried out when the detected brightness is smaller than the predetermined value.

20. The non-transitory computer readable medium according to claim 15, wherein the method further comprises:

determining an operational mode of the decoloring apparatus, the operational mode including a normal mode and a stand-by mode during which energy consumption of the decoloring apparatus is smaller than during the normal mode, wherein the controlling of the sheet conveying unit and the erasing unit is carried out when the decoloring apparatus is in the stand-by mode and not in the normal mode.

* * * * *